United States Patent [19]

Roberts

[11] Patent Number: 4,755,074

[45] Date of Patent: Jul. 5, 1988

[54] PENCIL SHARPENER

[76] Inventor: Myrtle M. Roberts, 437 N. Maple Ave., East Orange, N.J. 07017

[21] Appl. No.: 908,232

[22] Filed: Sep. 17, 1986

[51] Int. Cl.[4] ..... B43K 29/06; B43K 29/02

[52] U.S. Cl. ..... 401/52; 15/105.53; 30/460; 30/461; 144/28.11; 401/50

[58] Field of Search ..... 401/50, 51, 52; 30/451, 30/453, 454, 455, 457, 458, 459, 460, 461, 462; 15/105.53; 144/28.11

[56] References Cited

U.S. PATENT DOCUMENTS

| | | | |
|---|---|---|---|
| 179,641 | 7/1876 | Batchelder | 401/50 X |
| 245,250 | 8/1881 | Williams | 15/105.53 |
| 441,384 | 11/1890 | Trego | 15/105.53 |
| 454,623 | 6/1891 | Baumgarten | 30/460 |
| 521,016 | 6/1894 | Chambers | 30/459 X |
| 562,303 | 6/1896 | Kaiser | 401/51 |
| 749,011 | 1/1904 | Adams | 15/105.53 |
| 895,019 | 8/1908 | Hopkins | 15/105.53 |
| 895,188 | 8/1908 | Mueller | 401/51 X |
| 969,323 | 9/1910 | Anderson | 30/461 |
| 1,822,994 | 9/1931 | Markowitz | 15/105.53 |
| 2,624,316 | 1/1953 | Blanco et al. | 30/461 |

*Primary Examiner*—Steven A. Bratlie

*Attorney, Agent, or Firm*—McAulay, Fields, Fisher, Goldstein & Nissen

[57] ABSTRACT

The disclosure is directed to a pencil sharpener device in which the sharpening element is slidably mounted within a support member for movement between a retracted position when not in use to a protracted position for use in sharpening the pencil. When in use, the sharpening element is movable to its protracted position to permit pencil shavings to fall free out of the support member during the sharpening operation. The disclosure further provides an eraser element or a combined eraser/marker assembly to be removably associated with the device.

23 Claims, 3 Drawing Sheets

PENCIL SHARPENER

BACKGROUND OF THE INVENTION

This invention is directed generally to a pencil sharpener, and more specifically, to a sharpening element movable within a support member to a position to permit pencil shavings to fall free therefrom.

Heretofore, it is known to support a sharpening element in a support member for use in sharpening a pencil. In one embodiment of such units, such as shown in U.S. Pat. Nos. 245,250 and 441,384, a protective cover in the form of an eraser is first removed to gain access to the sharpener element. In other applications, such as shown in U.S. Pat. Nos. 749,011; 895,019; and 1,822,994, the eraser element need not be removed to gain access to the sharpener. Further, in some of these prior patents, the pencil shavings fall free, whereas in others, the shavings are collected in the housing of the sharpener and are thereafter emptied when the pencil is removed from the housing.

The present invention represents an improvement over the general concepts expressed in the aforesaid patents by providing a sharpening element slidably mounted within a support member for movement between first and second positions. In the first position, the sharpening element is retracted within the support member for protection when not in use. In the second position, the discharge end of the sharpening element is protracted outside of the support member to permit pencil shavings to fall free during the sharpening operation.

SUMMARY

The pencil sharpener of the present invention comprises a sharpening element slidably mounted within a through-opening of a support or head member. The sharpening element is in the form of a cylindrical wall housing having an inwardly projecting segment struck therefrom to constitute a blade. The housing has an inlet opening adapted to receive one end of a pencil to be sharpened, and a discharge opening from which pencil shavings are discharged.

The sharpening element is disposed for movement within the head member between a retracted position wherein the discharge opening of the cylindrical housing is positioned within the head member, and a protracted position wherein the discharge opening is positioned outside of the head member. In one embodiment, the sharpening element is adapted to be engaged by inserted movement of the pencil within the inlet end opening of the housing to displace the sharpening element to its protracted position. In another embodiment, the sharpening element is adapted to be biased or displaced by a spring member to its protracted position whereupon the pencil is then inserted within the inlet opening of the housing. Thereafter, rotational movement of the engaged pencil and the sharpening element relative to each other causes the pencil to be sharpened by the blade, and enables the pencil shavings to fall free out of the discharge opening of the housing.

The invention further comprises an eraser element removably associated with the head member. In still a further embodiment, a marker element is removably associated with the head member, and the eraser element is removably mounted to the marker element.

For a better understanding of the invention and its various features and advantages, reference should be made to the following detailed description when taken in conjunction with the accompanying drawings.

DESCRIPTION OF THE PREFERRED EMBODIMENT

Figure 1:
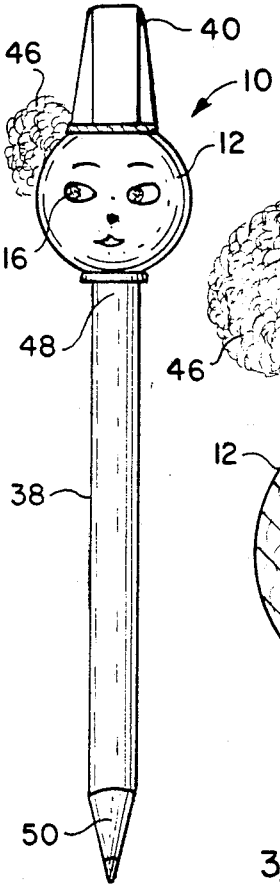
FIG. 1 is a front elevational view of the pencil sharpener embodying the present invention combined with a pencil and an eraser element.

Referring to the drawings, FIGS. 1–8 illustrate a pencil sharpener, represented generally by numeral 10, constructed in accordance with the present invention. Pencil sharpener 10 comprises a head member 12 having a through-opening represented generally by numeral 14. In the preferred embodiment, head member 12 is spherical in shape, and made of wood, plastic or metal. The outer surface is provided with painted facial markings or indicia 16 to resemble a doll's face.

Through-opening 14 of head 12 has a first portion 18 and a second portion 20 axially adjacent one another. First portion 18 is formed having a transverse dimension greater than the corresponding transverse dimension of second portion 20 to define a ledge 22 at the junction of said first and second portions. Ledge 22 serves as an abutment stop to limit advanced or protracted movement of a sharpening element 32 within head member 12 as will become hereinafter apparent.

Figure 2:
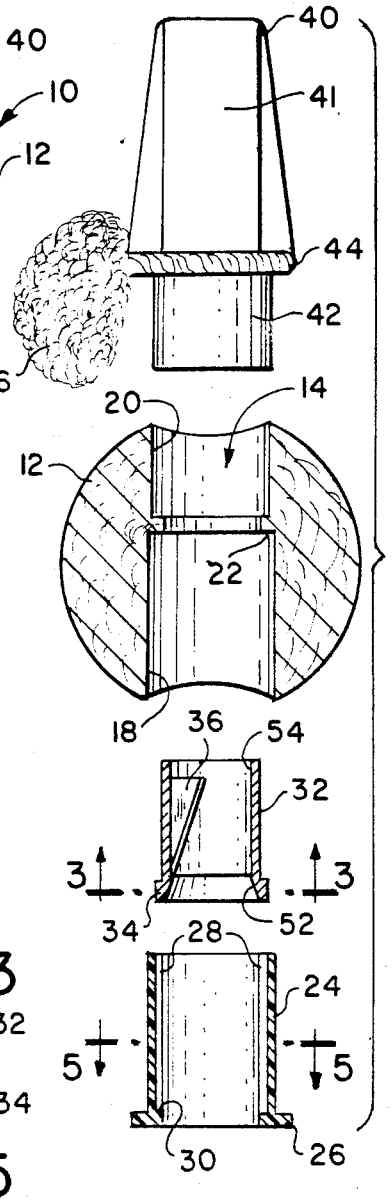
FIG. 2 is an exploded vertical view of the head member, the sharpening element, and the eraser element, with parts in section.
Figure 5:
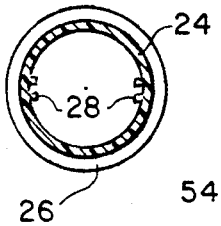
FIG. 5 is a cross-sectional view taken along line 5—5 of FIG. 2.

A sleeve member 24, in the form of a cylindrical housing, is adapted to be frictionally inserted into the opening portion 18 of head 12. A collar 26 projects outwardly from the lower end of sleeve 24, as shown in FIG. 2, and abuts against the outer surface of head 12 when the sleeve is in place. Sleeve 24 is formed having a pair of inwardly projecting channels 28 extending longitudinally of the sleeve, which channels terminate in a bottom wall 30. As shown in FIG. 5, the channels 28 are oppositely disposed and aligned to face one another. Sleeve 24 may be made of plastic or metal, and is coupled to the sharpening element 32 in the manner hereinafter described.

Sharpening element 32, also in the form of a cylindrical housing, is adapted to be slidably mounted within sleeve 24. For this purpose, the housing of sharpening element 32 is formed having a pair of outwardly projecting rails 34 which are diametrically opposed in alignment with one another. The housing 32 is preferably made of metal, and rails 34 may be stamped out of the housing wall portion at the lower end thereof. The arrangement is such that rails 34 are received within channels 28 when sharpening element 32 and sleeve 24 are telescopically mounted together to prevent relative rotation therebetween. In such nested condition, rails 34 abut against the bottom wall 30 of channels 28 to prevent sharpening element 32 from passing through the bottom of sleeve 24. A wall portion of housing 32 is stamped inwardly to constitute a blade 36 for sharpening one end of a pencil 38 in the manner hereinafter described.

An eraser element 40 is provided for engagement with head member 12. Eraser 40 is formed having an erasing or working end portion 41, and a depending stem portion 42 which is frictionally received within the opening portion 20 of head 12. Disposed between the erasing end and the depending stem of eraser 40 is a collar 44. Strand-like material, represented by numeral 46 is affixed to collar 44 to resemble hair, and thus complement the facial markings 18. Alternatively, hair material 46 could be affixed directly to head 12.

In assembly, once sharpening element 32 and sleeve 24 are nested together, the nested unit is fitted into the opening portion 18 of head 12. Eraser 40 is then fitted into the opening portion 20 of head 12. The assembled unit is now in condition to receive the pencil 38. In this regard, since the assembled unit includes eraser element 40, there is no need for pencil 38 to have its own separate eraser. Accordingly, pencil 38 is simply defined as having a mounting end 48 and a writing end 50.

As shown in FIG. 1, the end 48 of pencil 38 is adapted to be removably mounted in the lower opening of sleeve 24 when the pencil is in use for writing. However, when the housing of sharpening element 32 is fully nested within sleeve 24, the mounting end 48 of pencil 38 may be regarded as being frictionally received and removably mounted within an inlet end opening 52 of the housing 32.

Figure 6:
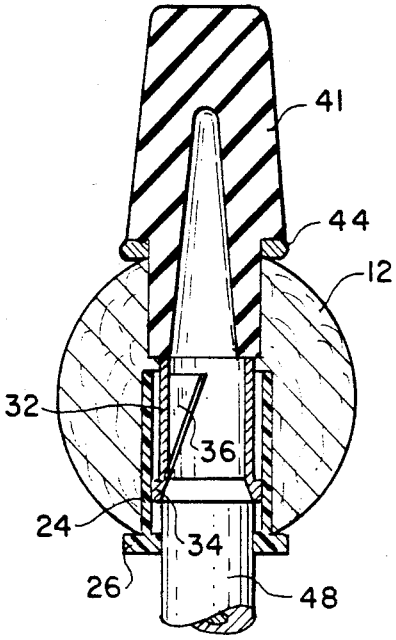
FIG. 6 is a vertical sectional view taken through the assembled unit of FIG. 1.
Figure 7:
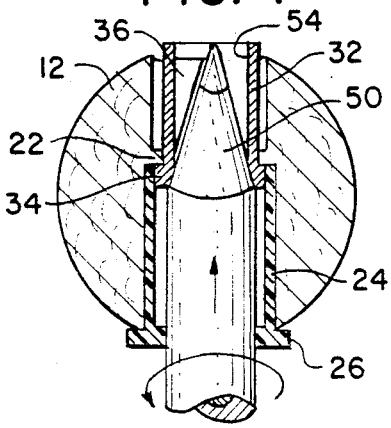
FIG. 7 is a vertical sectional view taken along the same plane as FIG. 6 with the eraser removed, and the pencil inserted for operative engagement with the sharpening element.
Figure 3:
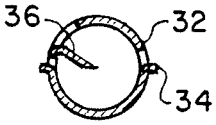
FIG. 3 is a cross-sectional view taken along line 3—3 of FIG. 2.
Figure 8:
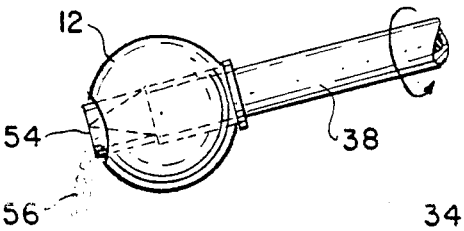
FIG. 8 is a side elevational view of the engaging members of FIG. 7 showing the pencil being sharpened and the shavings falling free.
Figure 4:
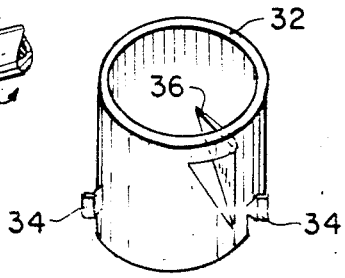
FIG. 4 is a perspective view of the sharpening element.

In describing the sharpening operation, the housing 32 which defines the sharpening element has a discharge end opening 54, opposite to inlet end opening 52, from which pencil shavings are discharged. More specifically, sharpening element 32 is disposed for movement within head member 12 between a retracted position, as shown in FIG. 6, wherein the discharge end opening 54 is positioned within head 12, and a protracted position, as shown in FIGS. 7 and 8, wherein discharge end opening 54 is positioned outside of head 12.

At such time as the writing end 50 of pencil 38 is to be sharpened, eraser 40 is removed from head member 12 and the pencil writing end 50 is inserted into the inlet end opening 52 of housing 32. Pencil 38 is then advanced inwardly of housing 32 to engage blade 36 whereupon continued advanced movement of the pencil inwardly of the housing serves to displace sharpening element 32 to its protracted position, as shown in FIGS. 7 and 8. At this point, the outwardly projecting rails 34 of sharpening element 32 abut against ledge 22 to limit further advanced movement of sharpening element 32 within head 12. Thereupon, rotational movement of the engaged pencil 38 and sharpening element 32, relative to each other, causes the pencil writing end 50 to be sharpened by blade 36. As is now apparent, since the sharpening of the pencil takes place when sharpening element 32 is in its protracted position to locate the discharge end opening 54 outside of head 12, the pencil shavings 56 fall free out of the discharge end opening of the housing.

FIGS. 9–13 illustrate another embodiment of the pencil sharpener 10' in which those portions common to the embodiment of FIGS. 1–8 are designated by the same reference numbers. In this embodiment, the facial markings or indicia 16 on head member 12 resemble a clown's face, and the eraser assembly 60 is shaped to resemble a hat.

An important feature of this embodiment is that the eraser does not have to be removed from the head member 12 during the sharpening operation. The eraser is designated generally by an assembly 60 which includes a base collar 62 having a cone-shaped marker element 64 projecting upwardly therefrom. The lower portion of marker 64 is formed having a circular recess or groove 66 positioned adjacent collar 62. A cone-shaped eraser element 68 is removably mounted to marker 64 by a snap-fit engagement. For this purpose, the lower inner surface of eraser 68 is formed having an inwardly projecting bead or collar 70 which is frictionally received within groove 66 of marker 64. Eraser 68 may be easily snapped- off marker 64 to expose the marking end 72 for use when desired. An opening 74 is provided in marker 64 for refilling ink therein as required. Depending downwardly from collar 62 is a threaded stem 76 for the purpose of removably attaching the eraser/marker assembly 60 to the sharpening unit as hereinafter described.

Head member 12 for this embodiment closely resembles the head member of FIGS. 1–8 except that the first portion 18 of through-opening 14 for this embodiment extends for substantially the entire height of the head. However, there is still formed a shoulder or abutment ledge 22 at the juncture of said first and second portions 18 and 20, respectively, of the through-opening. The abutment ledge 22 of head 12, the rails 34 of sharpening element 32, and the bottom wall 30 of sleeve member 24 perform the same functions as previously noted in connection with the embodiment of FIGS. 1–8.

The sleeve 24 and the sharpening element 32 for this embodiment also have an increased height or longitudinal extent to fit within the first portion 18 of head 12. The end opening 54 of sharpening element 32 is internally threaded, as represented by numeral 78. The arrangement is such that when the nested sleeve 24 and sharpening element 32 are fitted within head 12, the threaded stem 76 of eraser/marker assembly 60 is positioned to pass through the second portion 20 of head 12 and engage with the threaded portion 78 of the sharpening element. To the extent that the stem 76 passes through opening 20, such engagement permits the eraser/marker assembly 60 to be defined as being associated with the head member 12.

Figure 10:
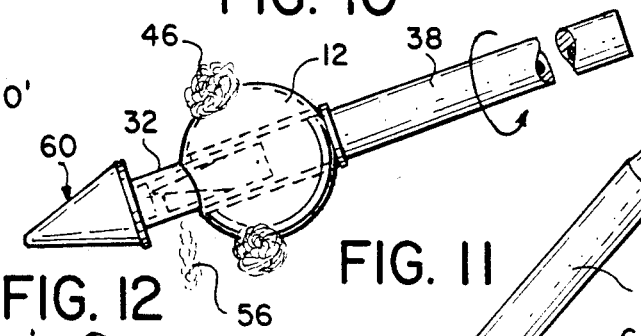
FIG. 10 is a side elevational view of the pencil sharpener embodiment of FIG. 9 showing the pencil being sharpened and the shavings falling free.
Figure 11:
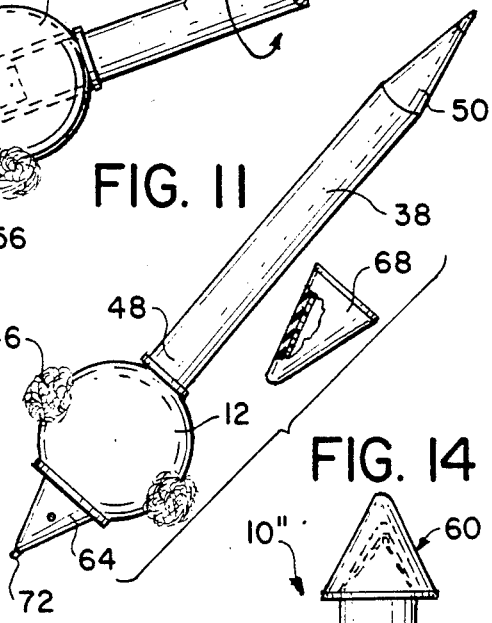
FIG. 11 is a side elevational view of the pencil sharpener embodiment of FIG. 9 with the eraser element removed to expose a marker element for use.
Figure 12:
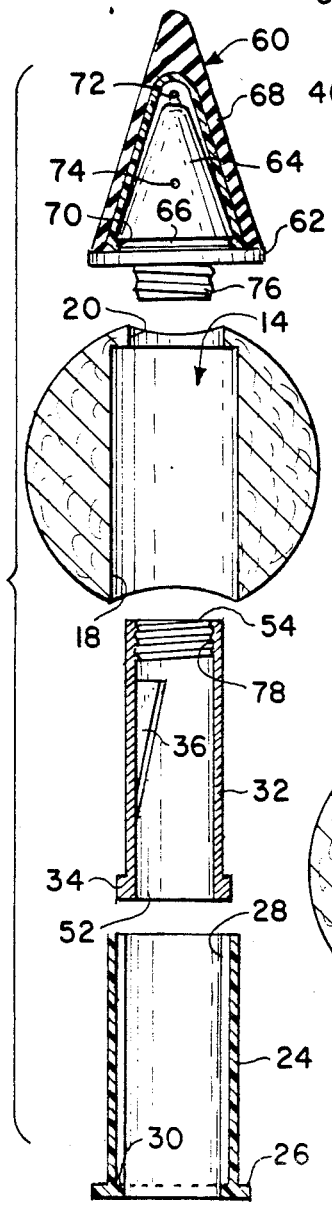
FIG. 12 is an exploded vertical view of the head member, the sharpener element, and the eraser element of the embodiment of FIG. 9, with parts in section, and with the eraser element mounted to the marker element.
Figure 13:
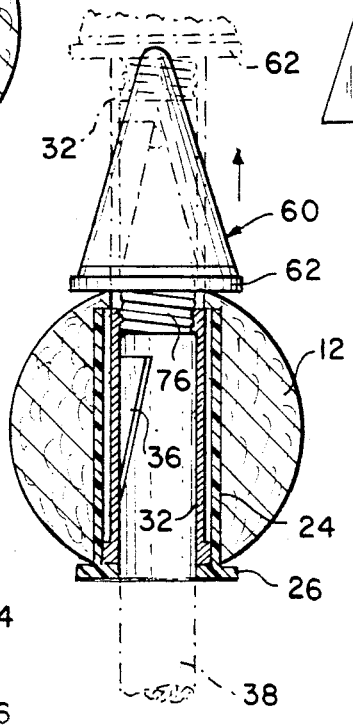
FIG. 13 is a vertical sectional view taken through the assembled unit of FIG. 9, with the phantom line showing the pencil inserted for operative engagement with the sharpening element.

As will now become apparent, particularly with reference to FIG. 10, when sharpening element 32 is displaced to its protracted position by the inserted movement of pencil 38, the end opening 54 of housing 32 is positioned outside of head 12 to permit the pencil shavings 56 to fall free out of a wall opening in the housing.

Specifically, as noted in the prior embodiment, the blade is stamped out of the wall of housing 32. The stamping operation in forming the inwardly projecting blade defines an opening in the housing wall. It is through this wall opening that the pencil shavings pass during the sharpening operation of the embodiment of FIG. 10. Further, when the sharpening element 32 is in its protracted position, the eraser/marker assembly 60 remains threadedly engaged to the sharpening element 32 but is sufficiently spaced from the blade 36 as to not interfere with the sharpening operation.

Figure 9:
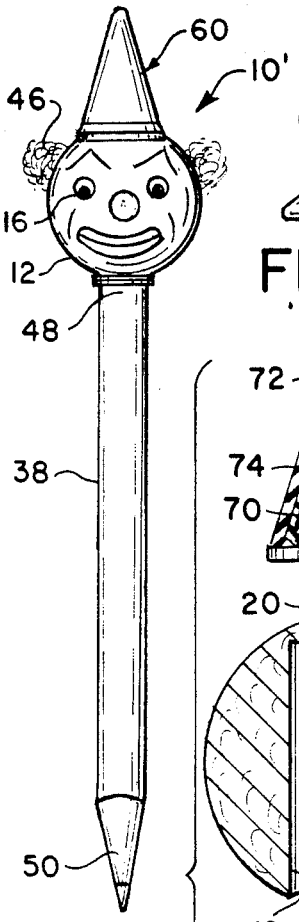
FIG. 9 is a view similar to FIG. 1 showing another embodiment of the invention, and wherein the outer surface of the head member is painted to resemble a clown's face, and the eraser element is shaped to resemble a hat.
Figure 14:
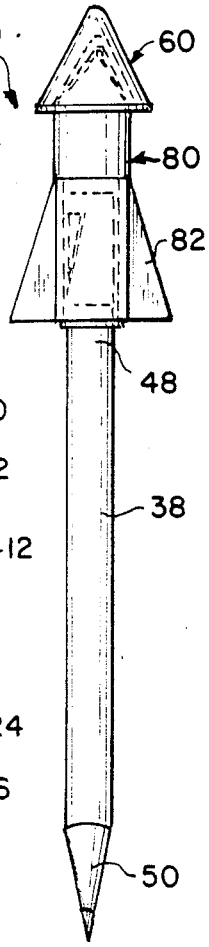
FIG. 14 is a front elevational view of still another embodiment of the invention, similar in construction to that of FIG. 9, but showing the outer configuration of the assembled head member and eraser element to resemble the shape of a rocket ship in place of the clown's face and hat.

FIG. 14 represents yet a further embodiment of the pencil sharpener 10″, similar to that of FIG. 9. For this embodiment, the spherical head element is replaced with a cylindrical body 80 which is provided with fins 82 to resemble a rocket ship. In all other aspects, the internal structure and sharpening operation is the same as that for the embodiment of FIG. 9.

Figure 15:
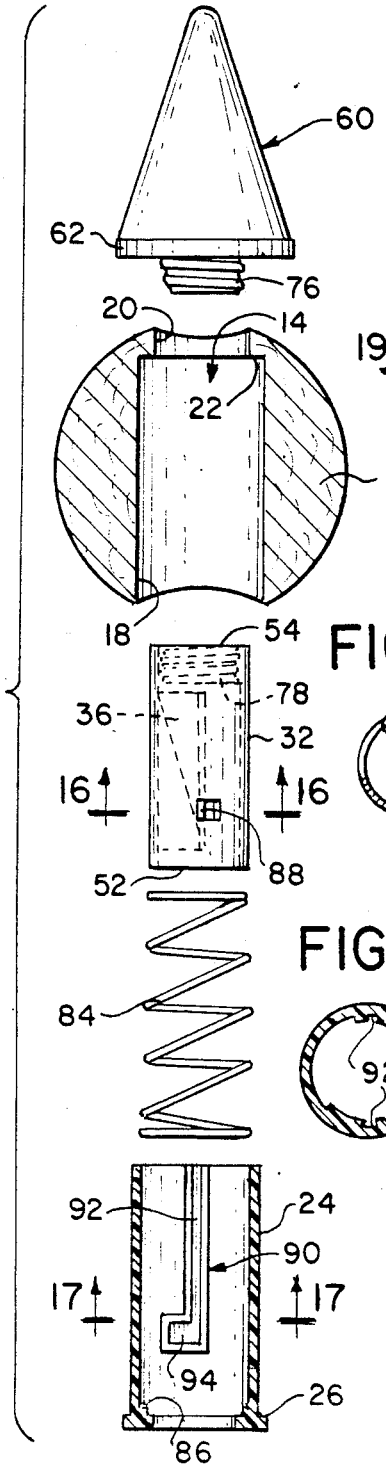
FIG. 15 is an exploded vertical view of still another embodiment of the invention, with parts in section, showing the sharpening element associated with a spring member for displacing the sharpening element to its protracted position when the pencil sharpener is in use.

FIGS. 15–20 illustrate yet another embodiment of the pencil sharpener 10‴, similar to that of FIGS. 9–13. Accordingly, those portions common to the embodiments of FIGS. 9 and 15 are designated by the same reference numbers.

For the embodiment of FIGS. 15–20, instead of using a pencil to displace sharpening element 32 to its protracted position, the device incorporates a biasing element, in the form of a compression spring 84, disposed between the bottom wall 86 of sleeve 24 and the bottom edge of sharpening element 32. The sharpening element is also modified to eliminate the lower rails 34 and provide, instead, a pair of outwardly projecting rails 88 located at a position approximately one-quarter the height of the sharpening element measured from its bottom edge. The rails 88 may be stamped out of the wall of the sharpening element 32, and are diametrically opposed in alignment with one another.

The sleeve member 24 also is modified in that the channels 28 are replaced with a different pair of inwardly projecting and oppositely disposed channels 90 aligned to face one another. Channels 90 each have a first portion 92 which extends downwardly longitudinally of the sleeve and terminates in a second portion 94 laterally off-set to first channel portion 92 and in communication therewith. Second channel portion 94 is located at a position on sleeve 24 such that the engagement between the rails 88 and the second channel portions 94 function as releasably engaging latch members for maintaining the sharpening element 32 in its retracted position in the manner hereinafter described.

Figure 20:
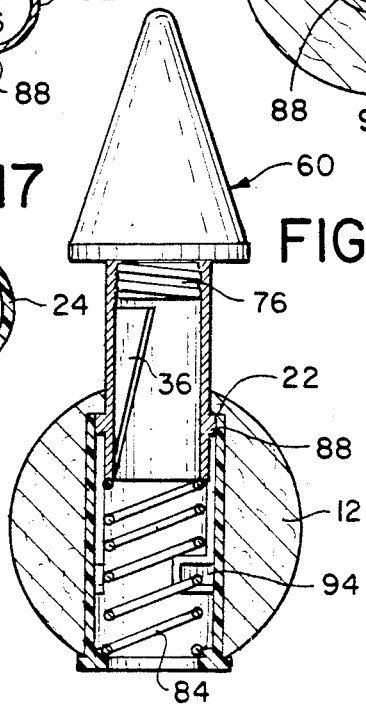
FIG. 20 is a vertical sectional view, similar to that of FIG. 18, showing the sharpening element biased to its protracted position by the spring member, and ready to receive a pencil for sharpening.

In operation, rails 88 are received in first channel portions 92 when sharpening element 32 is slidably mounted within sleeve 24 with the spring 84 positioned between the sharpening element 32 and the bottom wall 86 of sleeve 24. With the parts assembled, spring 84 is normally in an expanded state, as shown in FIG. 20, to displace sharpening element 32 to its protracted position when the sharpener is in use. In such protracted position, rails 88 ride upwardly in first channel portions 92 and abut against ledge 22 to limit further advanced movement of sharpening element 32 within head 12. The pencil may now be inserted into the sharpener and sharpened in the manner previously described to enable the pencil shavings to fall free out of the discharge opening of the housing.

Figure 18:
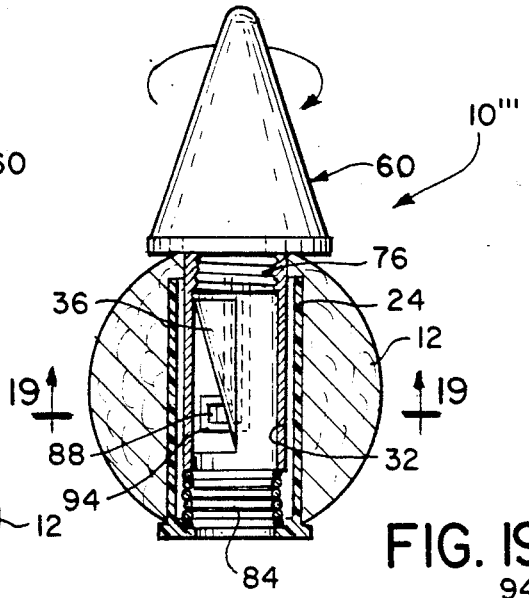
FIG. 18 is a vertical sectional view of the assembled components of the embodiment of FIG. 15 with the sharpening element in its retracted position.
Figure 19:
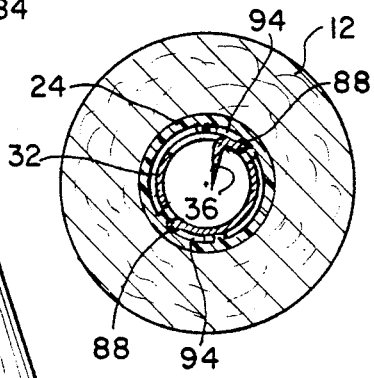
FIG. 19 is a cross-sectional view taken along line 19—19 of FIG. 18.
Figure 16:
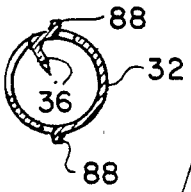
FIG. 16 is a cross-sectional view taken along line 16—16 of FIG. 15.
Figure 17:
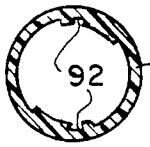
FIG. 17 is a cross-sectional view taken along line 17—17 of FIG. 15.

After the sharpening operation is completed and the pencil removed from the device, the sharpening element 32 is pushed downwardly, against the force of spring 84, to move the sharpening element to its retracted position as shown in FIG. 18. In such retracted position, spring 84 is in a compressed state with the rails 88 positioned at the lower end of first channel portions 92. Thereafter, upon rotation of sharpening element 32 relative to sleeve 24, in the direction of the arrow shown in FIG. 18, rails 88 are received in the second channel portion 94 thereby to latch sharpening element 32 in its retracted position. At such time as the pencil is again to be sharpened, sharpening element 32 is counter-rotated to unlatch said element from its retracted position whereupon unrestrained movement of spring 84 to its expanded state serves to, again, displace sharpening element 32 to its protracted position.

In all other aspects, such as the provision of an eraser/marker assembly 60, the structure and operation of this embodiment is the same as that of FIGS. 9–13.

There is thus provided a novel pencil sharpener in which the sharpening element is slidably mounted within a support member for movement between a retracted position when not in use to a protracted position for use in sharpening the pencil. The support member protects the sharpener in its retracted position and prevents it from coming in contact with foreign objects. The support member also represents a decorative structure for conveniently housing the sharpening element, and supporting an eraser and/or marker element. When in use, the sharpening element is movable to its protracted position either by an engaged pencil or by a spring member to permit pencil shavings to fall free out of the support member during the sharpening operation.

While the present invention has been described with respect to particular embodiments, it will be readily appreciated and understood that numerous variations and modifications thereof may be made without departing from the spirit or scope of the claimed invention.

I claim:

1. A pencil sharpener comprising:

a head member having an opening therethrough; and a sharpening element slidably mounted within the through-opening of said head member;

said sharpening element comprising a cylindrical housing having a blade mounted within said housing, said housing having an inlet opening adapted to receive a pencil to be sharpened and a discharge opening from which pencil shavings are discharged;

said sharpening element disposed for movement within said head member between a retracted position wherein the discharge opening of said housing is positioned within said head member and a protracted position wherein said discharge opening is positioned outside said head member;

said sharpening element, including said housing and said blade, being entirely positioned within said head member when said sharpening element is in its retracted position; and said blade being positioned within said housing in both of said retracted and protracted positions of said sharpening element;

said sharpening element adapted to be engaged by inserted movement of the pencil within the inlet opening of said housing, whereby rotational movement of the engaged pencil and said sharpening element relative to each other when said sharpening element is in its protracted position causes the pencil to be sharpened by said blade, and enables the pencil shavings to fall free out of the discharge opening of said housing.

2. The pencil sharpener of claim 1, wherein said sharpening element is adapted to be engaged by inserted movement of the pencil within the inlet opening of said housing to displace said sharpening element to its protracted position.

3. The pencil sharpener of claim 1, wherein the through-opening of said head member has a first portion and a second portion axially adjacent one another, an abutment ledge formed at the juncture of said first and second portions, and said housing having an outwardly projecting rail which abuts against said ledge when said sharpening element is in its protracted position to prevent said sharpening element from passing entirely through said head member.

4. The pencil sharpener of claim 3, wherein said first through-opening portion has a transverse dimension greater than the corresponding transverse dimension of said second through-opening portion.

5. The pencil sharpener of claim 3, further comprising a sleeve member frictionally mounted within the first through-opening portion of said head member, said sleeve having an inwardly projecting channel extending longitudinally thereof, said sharpening element being slidably mounted within said sleeve for movement between its retracted and protracted positions, and said rail being received within said channel when said sharpening element and said sleeve are telescopically mounted together to prevent relative rotation therebetween.

6. The pencil sharpener of claim 5, wherein said channel of said sleeve terminates in a bottom wall; said rail of said sharpening element disposed to abut against said bottom wall when said sharpening element is in its fully retracted position in said sleeve to prevent said sharpening element from passing through the bottom of said sleeve.

7. The pencil sharpener of claim 3, further comprising a sleeve member frictionally mounted within the first through-opening portion of said head member, said sharpening element being slidably mounted within said sleeve for movement between its retracted and protracted positions, and biasing means supported within said sleeve and operatively engaged with said sharpening element for displacing said sharpening element to its protracted position when the sharpener is in use.

8. The pencil sharpener of claim 7, wherein said biasing means comprises a spring disposed between an inner wall of said sleeve and the housing of said sharpening element, said spring being in a compressed state when said sharpening element is in its retracted position and being actionable to an expanded state to displace said sharpening element to its protracted position, and releasably engaging latch means on said sleeve and said housing for maintaining said sharpening element in its retracted position against the force of said spring.

9. The pencil sharpener of claim 8, wherein said latch means comprises a channel projecting inwardly of said sleeve, said channel having a first portion extending downwardly longitudinally of said sleeve and terminating in a second portion laterally off-set to said first portion and communicating therewith, said rail being received in the first portion of said channel when said sharpening element is slidably mounted within said sleeve with said spring positioned between said sharpening element and said sleeve wall, and said rail being received in the second portion of said channel upon rotation of said sharpening element relative to said sleeve when said sharpening element is in its retracted position thereby to latch said sharpening element in its retracted position with the spring in its compressed state, whereby when said sharpening element is unlatched from its retracted position, said spring moves to its expanded state to displace said sharpening element to its protracted position.

10. The pencil sharpener of claim 1, further comprising an eraser element removably associated with said head member, said eraser element having a mounting stem receivable within the through-opening of said head member.

11. The pencil sharpener of claim 10, wherein the mounting stem of said eraser is receivable within the through-opening of said head member, and is removably mounted to said sharpening element.

12. The pencil sharpener of claim 1, further comprising a marker element removably associated with said head member.

13. The pencil sharpener of claim 12, further comprising an eraser element removably mounted to said marker element.

14. The pencil sharpener of claim 1, further comprising a marker element having a mounting stem receivable within the through-opening of said head member and removably mounted to said sharpening element.

15. The pencil sharpener of claim 14, further comprising an eraser element removably mounted to said marker element.

16. A combined pencil and pencil sharpener comprising:

a pencil having a mounting end and a writing end;

a head member having an opening therethrough, said through-opening having a first portion and a second portion axially adjacent one another;

an abutment ledge formed at the juncture of said first and second through-opening portions;

the mounting end of said pencil being removably mounted in the first through-opening portion of said head member when said pencil is in use for writing; and a sharpening element slidably mounted within the through-opening of said head member;

said sharpening element comprising a cylindrical housing having a blade mounted therein, said housing having an inlet opening adapted to receive the writing end of said pencil to be sharpened and a discharge opening from which pencil shavings are discharged;

said sharpening element disposed for movement within said head member between a retracted position wherein the discharge opening of said housing is positioned within said head member and a protracted position wherein said discharge opening is positioned outside said head member;

said sharpening element, including said housing and said blade, being entirely positioned within said head member when said sharpening element is in its retracted position; and said blade being positioned within said housing in both of said retracted and protracted positions of said sharpening element;

said housing having an outwardly projecting rail which abuts against said ledge when said sharpening element is in its protracted position to prevent said sharpening element from passing entirely through said head member;

said sharpening element being engaged by inserted movement of the writing end of said pencil within the inlet opening of said housing, whereby rotational movement of the engaged pencil and said sharpening element relative to each other when said sharpening element is in its protracted position causes the writing end of said pencil to be sharpened by said blade, and enables the pencil shavings to fall free out of the discharge opening of said housing.

17. The combined pencil and pencil sharpener of claim 16, wherein said sharpening element is engaged by inserted movement of said pencil within the inlet opening of said housing to displace said sharpening element to its protracted position.

18. The combined pencil and pencil sharpener of claim 16, further comprising a sleeve member frictionally mounted within the first through-opening portion of said head member, said sleeve having an inwardly projecting channel extending longitudinally thereof and terminating in a bottom wall, said sharpening element being slidably mounted within said sleeve for movement between its retracted and protracted positions, said rail being received within said channel when said sharpening element and said sleeve are telescopically mounted together to prevent relative rotation therebetween, and said rail disposed to abut against said bottom wall when said sharpening element is in its fully retracted position in said sleeve to prevent said sharpening element from passing through the bottom of said sleeve.

19. The combined pencil and pencil sharpener of claim 16, further comprising a sleeve member frictionally mounted within the first through-opening portion of said head member, said sharpening element being slidably mounted within said sleeve for movement between its retracted and protracted positions, a spring disposed between an inner wall of said sleeve and the housing of said sharpening element, said spring being in a compressed state when said sharpening element is in its retracted position and being actionable to an expanded state to displace said sharpening element to its protracted position, and releasably engaging latch means on said sleeve and said housing for maintaining said sharpening element in its retracted position against the force of said spring.

20. The combined pencil and pencil sharpener of claim 19, wherein said latch means comprises a channel projecting inwardly of said sleeve, said channel having a first portion extending downwardly longitudinally of said sleeve and terminating in a second portion laterally off-set to said first portion and communicating therewith, said rail being received in the first portion of said channel when said sharpening element is slidably mounted within said sleeve with said spring positioned between said sharpening element and said sleeve wall, and said rail being received in the second portion of said channel upon rotation of said sharpening element relative to said sleeve when said sharpening element is in its retracted position thereby to latch said sharpening element in its retracted position with the spring in its compressed state, whereby when said sharpening element is unlatched from its retracted position, said spring moves to its expanded state to displace said sharpening element to its protracted position.

21. The combined pencil and pencil sharpener of claim 16, further comprising an eraser element removably associated with said head member, said eraser element having a mounting stem receivable within the through-opening of said head member.

22. The combined pencil and pencil sharpener of claim 16, further comprising a marker element removably associated with said head member.

23. The combined pencil and pencil sharpener of claim 22, further comprising an eraser element removably mounted to said marker element.

* * * * *